US006361395B1

(12) United States Patent
Pacza

(10) Patent No.: US 6,361,395 B1
(45) Date of Patent: Mar. 26, 2002

(54) COIL FEATURES FOR TOYS AND DOLLS

(75) Inventor: Elizabeth Pacza, Chicago, IL (US)

(73) Assignee: Meyer/Glass Design, Ltd., Chicago, IL (US)

( * ) Notice: Subject to any disclaimer, the term of this patent is extended or adjusted under 35 U.S.C. 154(b) by 0 days.

(21) Appl. No.: 09/186,565

(22) Filed: Nov. 5, 1998

(51) Int. Cl.[7] ..... A63H 3/00

(52) U.S. Cl. ..... 446/368; 446/268; 446/370; 446/369

(58) Field of Search ..... 446/268, 368, 446/397, 486, 431, 370, 385, 26, 227, 170, 373; 63/11

(56) References Cited

U.S. PATENT DOCUMENTS

| | | | | | |
|---|---|---|---|---|---|
| 3,557,436 | A | * | 1/1971 | Hodes | 446/369 |
| 4,505,687 | A | * | 3/1985 | Munro | 446/368 |
| 5,431,591 | A | * | 7/1995 | Muzzi | 446/397 |
| 5,727,984 | A | * | 3/1998 | Lin | 446/431 |

* cited by examiner

*Primary Examiner*—Jacob K. Ackun, Jr.
*Assistant Examiner*—Urszula M. Cegielnik
(74) *Attorney, Agent, or Firm*—Marc J. Whipple

(57) ABSTRACT

A new toy for young children incorporating a coil feature is disclosed. A coil preferably an expansion spring, is covered with a sleeve. A head is then affixed to the coil, either directly or to the sleeve as an intermediary, forming the toy. The sleeve may also be extended past the end of the coil, forming a soft tail.

2 Claims, 3 Drawing Sheets

COIL FEATURES FOR TOYS AND DOLLS

BACKGROUND OF THE INVENTION

Coils, or expansion springs, have been used in toys for many years, the most famous application being the Slinky® toy and its variants. These provided entertainment and education to the user in developing hand-eye coordination and basic principles of science and logic in anticipating the reaction of the toy to a given manipulation. For example, in its basic form, the coil toy can actually "walk" down stairs or inclined planes if operated properly. These toys are not suitable for small children, as they can overextend and break, and sometimes, in the case of metal coils, pose a hazard due to sharp edges and corners. Furthermore, they have a very unaesthetic appearance, being very angular, regular, and unappealing to the eye.

It would be desirable to use the appealing properties of a coil toy in a form with more aesthetic and play value, while making it more suitable for use by small children. The present invention addresses these concerns.

OBJECTS OF THE INVENTION

An object of the invention is to provide a coil toy for the entertainment and education of children.

A second object of the invention is to provide a coil toy which is entertaining and aesthetic in appearance.

A third object of the invention is to provide a coil toy which is safe for children to use.

Other objects and advantages of the invention will become apparent in the following disclosure.

SUMMARY OF THE INVENTION

The present invention relates to a new toy for young children incorporating a coil feature. A coil, in the preferred embodiment an expansion spring, is covered with a sleeve to protect the user from being injured by contact with the coil and to allow an aesthetic appearance for the toy. A head is then affixed to the coil, either directly or to the sleeve as an intermediary, forming an entertaining and educational toy. The sleeve can also extend past the end of the coil, forming a soft tail for added effect.

BRIEF DESCRIPTION OF THE DRAWINGS

The characteristic features of the invention will be particularly pointed out in the claims. The descriptions of the preferred embodiment refer to the preceding drawings:

DESCRIPTION OF THE PREFERRED EMBODIMENT

In the preferred embodiment, the invention is practiced as an expansion spring with a low spring coefficient, the spring covered with a fabric sleeve, and a comical head attached to the sleeve, producing a plush character which can be manipulated in an entertaining and educational way. For purposes of this application, the term "coil" is used. This may mean any helical object with suitable properties for the desired application. In the preferred embodiment, the coil is an expansion spring with a relatively low spring coefficient, which allows it to be manipulated easily and expanded by even fairly young children, and therefore change dramatically in size when manipulated and then spring back to the original configuration. If desired, the coil can have different elastic properties: for example, it might have an extremely high spring coefficient, making it hard to expand or contract, but be formed in such a way that it is always partially expanded, making a toy which is always roughly the same size but which is very bouncy when shaken. The term "coil" should always be understood to have the broadest possible meaning. Typically, the coil will be made out of plastic or metal, and the sleeve out of a fabric with some elastic properties. although this is not required.

Figure 1:
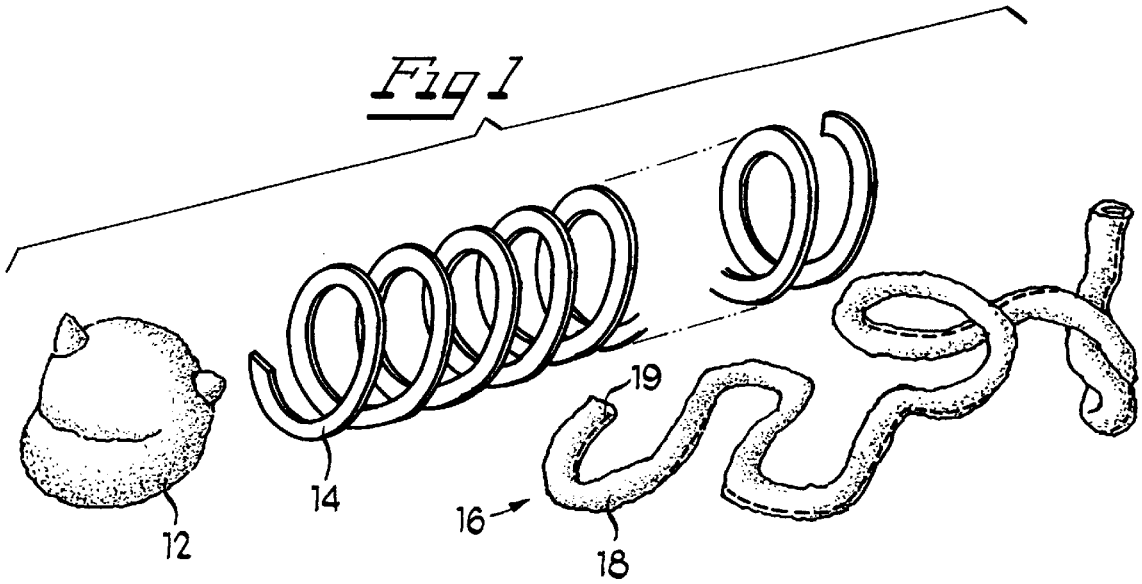
FIG. 1 is a perspective view of a representative assembly with components separated.

By referring to FIG. 1, the basic principle of the invention can easily be understood. Head 12, coil 14, and sleeve 16 are the basic components of the toy. Sleeve 16 comprises fabric 18 which is held in the desired shape by stitching 19. The fabric may also be fused, glued or formed into the sleeve by any desired means.

Figure 2:
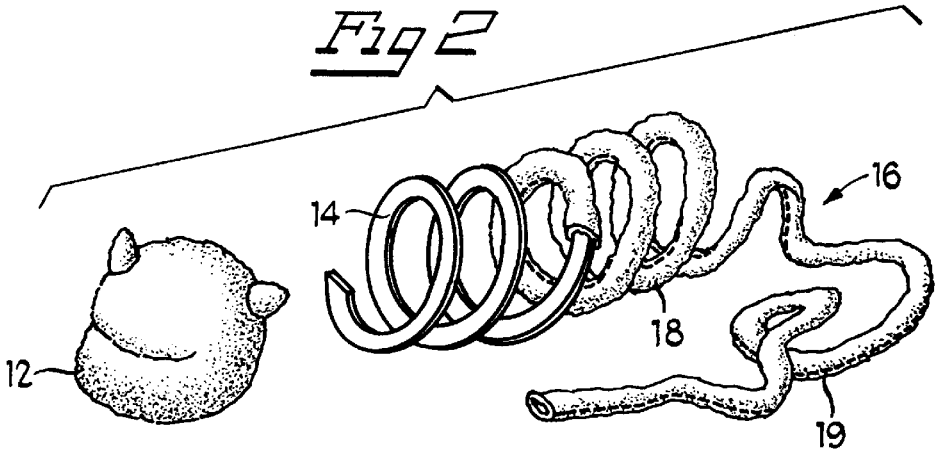
FIG. 2 is a perspective view of the toy showing the sleeve partially covering the coil.

FIG. 2 shows the invention partially assembled. Sleeve 16 is being slid onto coil 14 both to cover it and to provide a means for attaching coil 14 to head 12 in a strong and aesthetic manner.

Figure 3:
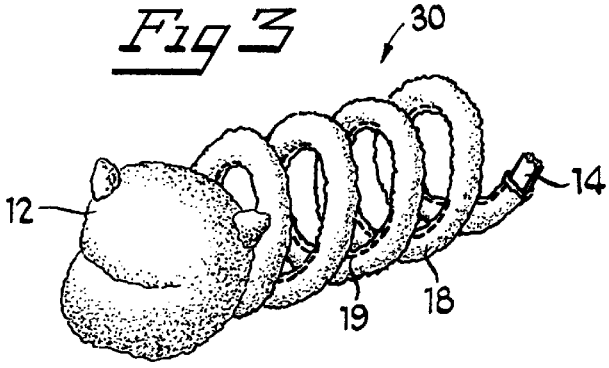
FIG. 3 is a perspective view of the toy with the head attached and the sleeve and coil visible.

FIG. 3 shows the assembled toy. Toy 30 has been formed by attaching coil 14 and sleeve 16 to head 12, as shown in detail in later drawings.

Figure 4:
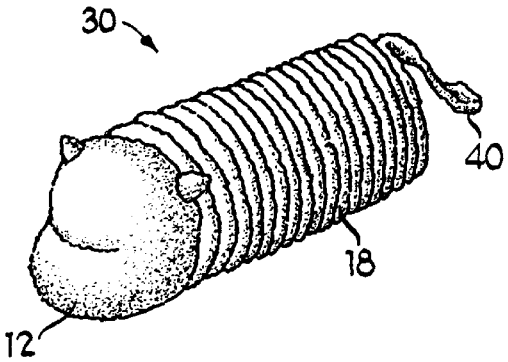
FIG. 4 is a perspective view of the toy fully assembled in the compressed position.

FIG. 4 shows the complete toy in the compressed position. Toy 30 comprises head 12, coil 14 (not visible—see preceding drawings,) with its covering sleeve, and tail 40. Tail 40 is an optional improvement formed by extending sleeve 16 so that it is somewhat longer than coil 14. The tail may be sewn or otherwise sealed at the end of coil 14 so that the tail is always the same length, but this is not required. It should be noted, however, that if the tail is not sealed then the coil will expand into it when extended. If coil 14 completely returns to the position shown when no external tension is applied, coil 14 would typically be referred to as an expansion spring.

Figure 5:
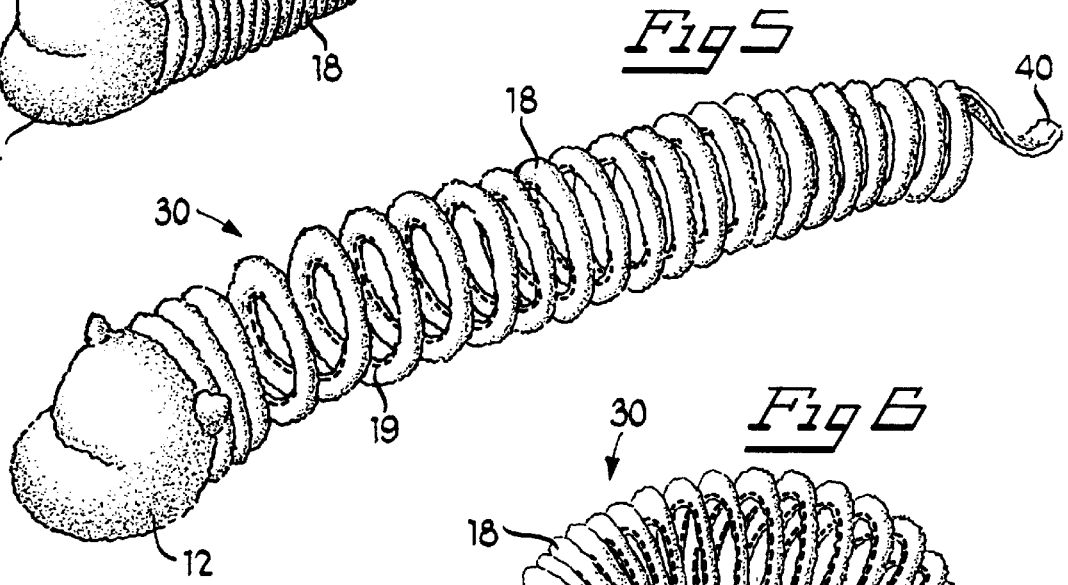
FIG. 5 is a perspective view of the toy fully assembled in the extended position.

FIG. 5 shows the toy completely assembled in the extended position. Some external tension would be applied, perhaps by pulling on head 12 and tail 40, and the toy would extend itself as shown. Alternatively, coil 14 could be formed in such a way that it returned to this position in the absence of external tension. The toy could then be compressed, forming the alignment shown in FIG. 4, and would bounce back when released. If this alternate embodiment were constructed, coil 14 would typically be referred to as a compression spring.

Figure 6:
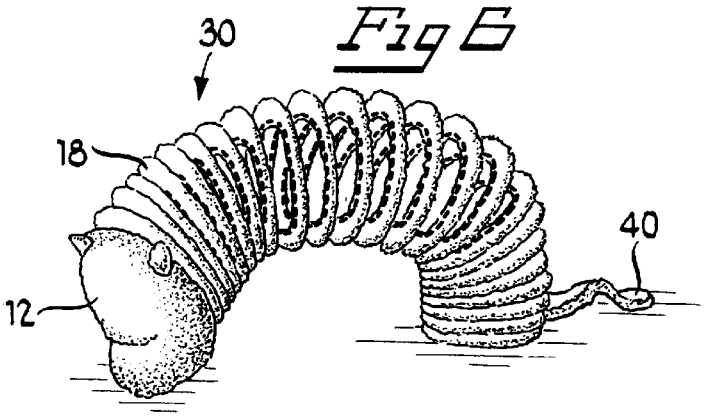
FIG. 6 is a perspective view of the toy showing the flexibility of the coil.

FIG. 6 shows another possible manipulation of toy 30. Here, coil 14 is distended in two dimensions, forming an extended arc. Again, if desired, coil 14 could also be formed to return to this position absent any external tension, so that the toy typically has a curved shape.

Figure 7:
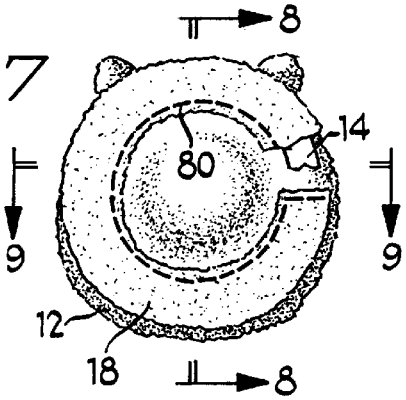
FIG. 7 is a rear view of the toy.

FIG. 7 shows an alternate view of the toy, with coil 14 shown in its relationship to fabric 18 and the head 12 visible beyond them. Stitching 80 fastens head 12 to fabric 18, holding the toy together. If desired, coil 14 can actually extend into head 12 somewhat, adding its mechanical strength to the join of stitching 80, but this is not required.

Figure 8:
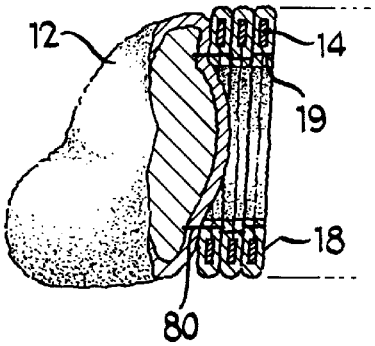
FIG. 8 is a side view of the toy showing the joining of the coil to the head.

FIG. 8 shows an alternate view of the attachment of the head 12 to coil 14 via stitching 80 which holds fabric 18 to the exterior of head 12.

Figure 9:
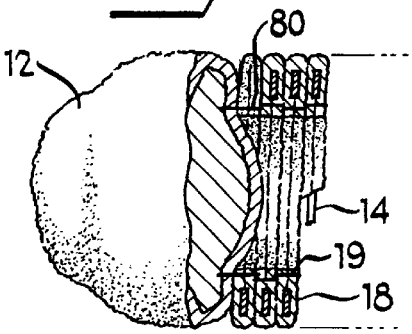
FIG. 9 is an overhead view of the toy showing the joining of the coil to the head.

FIG. 9 shows an alternate view of the attachment of the head 12 to coil 14 via stitching 80 which holds fabric 18 to the exterior of head 12.

Figure 10:
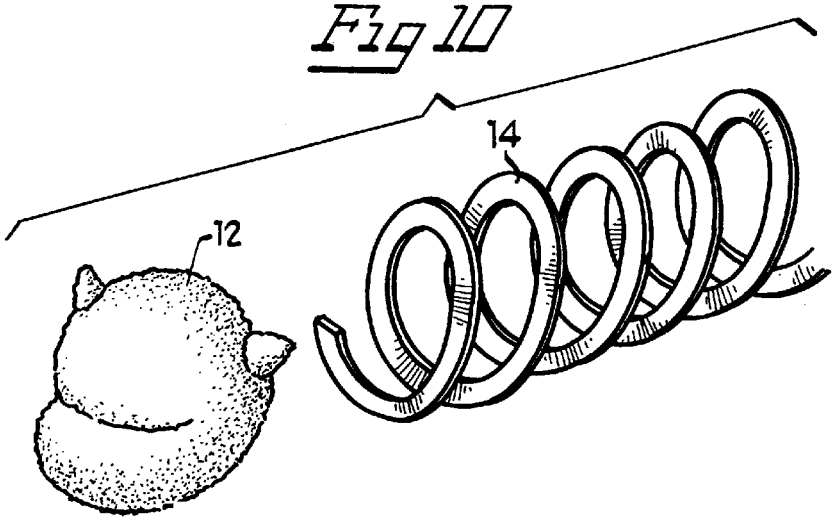
FIG. 10 is a perspective view of an alternate embodiment, partially-assembled

FIG. 10 shows an alternate embodiment in which the covering, instead of being a separate fabric sleeve, is a covering comprising a plurality of filaments embedded in a permanent adhesive, or "flocking," in general. In FIG. 10, head 12 has had the covering applied, but body 14 has not.

Figure 11:
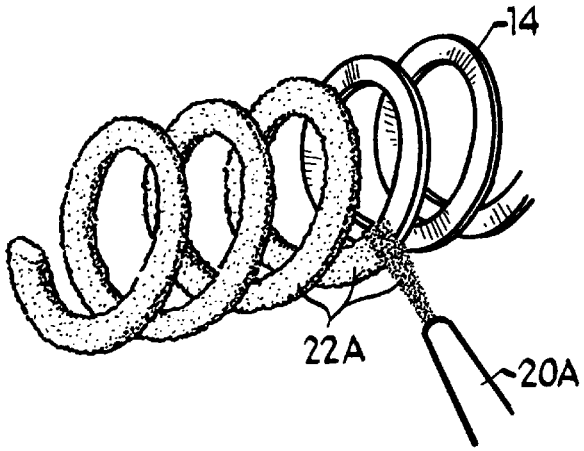
FIG. 11 is a perspective view of an alternate embodiment in the process of assembly.

FIG. 11 shows the application of the covering 22A. Applicator 20A is applying a mixture of filaments and adhesive, otherwise known as "flocking," to body 14 under pressure. Covering 22A then adheres to body 14. The pressure applied in applicator 20A, and the speed at which it is moved over body 14, controls the thickness of coverng 22A. It should be noted that this method of applying flocking is not essential, or even preferred, as many different methods of flocking a surface are known to those of ordinary skill in the relevant art. The application process itself is shown for reference only and forms no part of the claimed invention.

Figure 12:
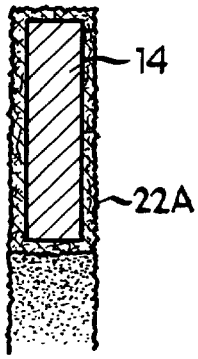
FIG. 12 is a cross-sectional view of an alternate embodiment showing the details of construction.

FIG. 12 shows a detail of the body 14 after covering 22A has been applied.

Figure 13:
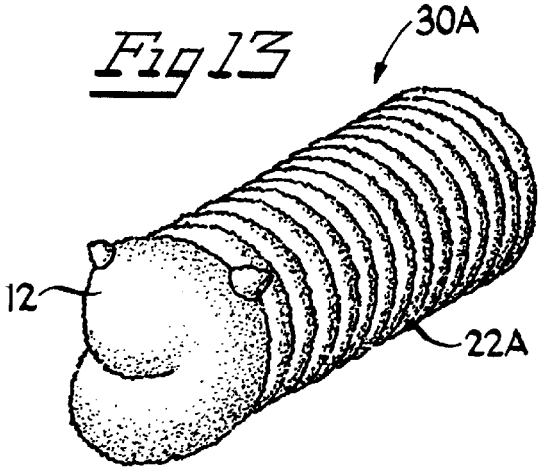
FIG. 13 is a perspective view of an alternate embodiment, fully assembled.

FIG. 13 shows a complete version of the alternate embodiment. Toy 30A has been formed by attaching head 12 to body 14, which is covered with covering 22A.

The above discussion shows that the present invention provides a coil toy for the entertainment and education of children. Furthermore, the present invention provides a coil toy which is entertaining and aesthetic in appearance. Finally, the present invention provides a coil toy which is safe for children to use. Therefore, the protection of a patent is requested for the invention as set forth in the claims below.

What is claimed is:

1. A coil toy with coil feature comprising:

A) A coiled member comprising a stiff elastic material formed as a series of tangent regular figures;

B) A sleeve, comprising a flocking, the flocking comprising an adhesive and a plurality of filaments, which covers the coiled member, and;

C) A head affixed to the coiled member.

2. A coil toy with coil feature comprising:

A) A coil, comprising a spring made of a stiff elastic material;

B) A sleeve, comprising a flocking, the flocking comprising an adhesive and a plurality of filaments, which covers the coil, and;

C) A head affixed to the coil.

* * * * *